United States Patent [19]

Levinson

[11] 4,323,642

[45] Apr. 6, 1982

[54] STABLE PHOTOGRAPHIC DEVELOPERS CONTAINING AN INDAZOLE ANTIFOGGANT AND A LIGNOSULFONATE

[75] Inventor: Steven R. Levinson, Rochester, N.Y.

[73] Assignee: Eastman Kodak Company, Rochester, N.Y.

[21] Appl. No.: 241,778

[22] Filed: Mar. 9, 1981

[51] Int. Cl.[3] ..... G03C 5/30

[52] U.S. Cl. ..... 430/438; 430/444; 430/446; 430/452; 430/467; 430/481; 430/485; 430/488; 430/489; 430/490; 430/491; 430/966

[58] Field of Search ..... 430/444, 438, 446, 452, 430/466, 467, 488, 491, 489, 481, 490, 966, 485; 260/17.5

[56] References Cited

U.S. PATENT DOCUMENTS

| | | | |
|---|---|---|---|
| 2,271,229 | 1/1942 | Peterson et al. | 95/88 |
| 2,865,746 | 4/1958 | Bloom et al. | 96/48 |
| 3,471,309 | 10/1969 | Thompson | 430/203 |
| 3,515,556 | 6/1970 | Russell et al. | 96/63 |
| 3,972,719 | 8/1976 | Vanreusel | 430/446 |
| 4,172,728 | 9/1979 | Sincius et al. | 96/66 |

FOREIGN PATENT DOCUMENTS 1437053 11/1976 United Kingdom .

*Primary Examiner*—Mary F. Downey
*Attorney, Agent, or Firm*—A. P. Lorenzo

[57] ABSTRACT

Lignosulfonates are incorporated in photographic developing compositions containing an indazole antifoggant in order to prevent or retard the precipitation of the indazole. Both black-and-white developing compositions, containing such developing agents as dihydroxybenzenes and/or pyrazolidones, and color developing compositions, containing primary aromatic amino color developing agents, are effectively stabilized against precipitation of indazole antifoggants by the lignosulfonates.

16 Claims, No Drawings

STABLE PHOTOGRAPHIC DEVELOPERS CONTAINING AN INDAZOLE ANTIFOGGANT AND A LIGNOSULFONATE

FIELD OF THE INVENTION

This invention relates in general to the photographic art and in particular to novel photographic developing compositions. More specifically, this invention relates to photographic developing compositions containing a developing agent, an indazole antifoggant, and an agent which functions to suppress precipitation of the indazole antifoggant.

BACKGROUND OF THE INVENTION

It is well known to use an indazole as an antifoggant in a photographic developing composition. The indazoles have been used for this purpose in both black-and-white developing compositions and color developing compositions. Among the many patents disclosing such use are Peterson et al, U.S. Pat. No. 2,271,229 issued Jan. 27, 1942, which describes the incorporation of indazole antifoggants in both black-and-white and color developers; British Pat. No. 1,437,053 published May 26, 1976, which describes the use of indazoles as antifoggants in X-ray developers; and Sincius et al, U.S. Pat. No. 4,172,728, issued Oct. 30, 1979, which describes the use of indazoles as antifoggants in developers for graphic arts processes.

While the indazoles are very effective antifoggants, it is frequently necessary to utilize them at relatively high concentrations and, under such conditions, a serious problem arises in that they tend to undergo precipitation. This is particularly the case where a developing solution containing an indazole antifoggant is stored at relatively low temperatures. Under such conditions, it is common for the indazole to precipitate as a very fine crystalline material. This reduces the concentration of dissolved indazole which is available to provide antifoggant action and is also deleterious because the precipitate can adhere to the photographic film or paper and adversely affect its physical characteristics. In addition to temperature, there are other factors that affect the tendency for precipitation to occur, and it is believed that one such factor that is particularly important is the degree of purity of the indazole. Thus, for example, very pure indazole antifoggants are generally much less soluble than impure indazole antifoggants, since the impurities are capable of allowing preparation of solutions that are beyond their normal thermodynamic stabilities, i.e., that are both supersaturated and stable. However, the inevitable variation in the amount and type of impurities present means that there is an inherent instability problem associated with the use of indazole antifoggants. This lack of stability of developing compositions containing indazole antifoggants has seriously hampered their commercial utilization.

It is toward the objective of providing a stable photographic developing composition, in which an indazole is utilized as an antifoggant and in which there is little or no tendency for precipitation of the indazole to occur, that the present invention is directed.

SUMMARY OF THE INVENTION

It has now been discovered that incorporation of a lignosulfonate in a photographic developing composition containing an indazole antifoggant will prevent, or at least significantly reduce, precipitation of the indazole. The lignosulfonates can be used for this purpose in either black-and-white or color developing compositions. Accordingly, this invention provides stable photographic developing compositions containing, as essential components, a developing agent, an indazole antifoggant, and a lignosulfonate in an amount sufficient to suppress precipitation of the indazole.

DESCRIPTION OF THE PREFERRED EMBODIMENTS

The lignosulfonates are well known commercially available materials. They have found extensive industrial application as dispersants, binders, chelating agents, flotation reagents, emulsifiers, emulsion stabilizers and water treatment agents. While to the best of applicant's knowledge, lignosulfonates have not been used heretofore to suppress unwanted precipitation of components of photographic developers, they have been previously used in photographic processing compositions for other purposes. For example, U.S. Pat. No. 2,865,746, "Tinting Bath For Photographic Paper," Roy C. Bloom and Henry J. Fassbender, issued Dec. 23, 1958, describes the use of lignosulfonates in a tinting bath for producing old ivory and buff tints on photographic paper. Also, the hemlock tannin polymers which, like the lignosulfonates, are chemicals derived from wood, have been used in photographic processing compositions, including developing compositions, to avoid the formation of unwanted markings during continuous transport processing of photograpic materials. This is described in U.S. Pat. No. 3,515,556, "Photographic Developing Process Utilizing Hemlock Tannin Polymer," Harold D. Russell and Charles E. Amering, issued June 2, 1970. As disclosed in this patent, the hemlock tannin polymers are very effective in avoiding so-called "pi line markings," but the lignosulfonates are not effective for this purpose.

While applicant does not wish to be bound by any theoretical explanation of the manner in which his invention functions, it is believed that the lignosulfonates serve in the developing compositions of this invention as crystal growth control agents. Such control could involve the formation of complexes and/or protective colloid activity which prevents the growth of one crystal at the expense of others.

Lignin is the major noncarbohydrate constituent of wood. The lignosulfonates are sulfonate salts which are typically made from the lignin of sulfite pulp-mill liquors. They are commercially available as ammonium salts and as salts of metals such as sodium or calcium. They are hetero-disperse polymers whose molecular weights are typically in the range from about 1,000 to about 100,000 and can be characterized as water-soluble, anionic, surface-active derivatives of lignin. Their exact structural formula is not known.

Lignosulfonates are available commercially from a number of sources, for example, as MARASPERSE dispersants from American Can Company, as LIGNOSOL dispersants from the Chemical Division of Reed Ltd., as ORZAN dispersants from Crown Zellerbach, as POLYFON dispersants and REAX dispersants from Westvaco and as LIGNOSITE dispersants from Georgia Pacific. The commercial lignosulfonates differ substantially in their degree of purity, with the cruder forms containing a high percentage of wood sugar derivatives. Different grades may differ significantly in other factors, such as the degree of sulfonation and the molecular weight.

Lignosulfonates and methods for their preparation have been described in the patent literature, for example, in U.S. Pat. Nos. 2,104,701, 2,491,832 and 4,069,217 and in U.S. Pat. No. Re. 18,268.

The indazole antifoggants are well known and have been used in photographic developing compositions for many years. A wide variety of such compounds are effective; all of them being characterized by the presence of the indazole nucleus which has the structure:

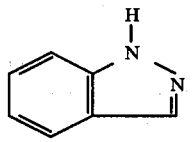

Illustrative examples of the indazole antifoggants include the following:

5-nitroindazole
5-aminoindazole
5-p-toluenesulfonamido indazole
5-chloroindazole
5-benzoylacetamino indazole
5-cyanoindazole
5-p-nitrobenzoylamino indazole
1-methyl-5-nitro-indazole
6-nitroindazole
3-methyl-5-nitro-indazole
4-chloro-5-nitro-indazole, and the like.

The nitroindazoles are preferred for use in the developing compositions of this invention. An especially preferred compound is 5-nitroindazole, which has the formula:

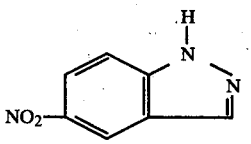

In the practice of this invention, the indazole antifoggants can be used as the sole antifoggant in the developing composition. Alternatively, they can be used in combination with other antifoggants such as the benzotriazoles.

Developing agents of both organic and inorganic types are well known in the photographic art. Useful classes of organic developing agents include hydroquinones, catechols, aminophenols, pyrazolidones, phenylenediamines, tetrahydroquinolines, bis(pyridone) amines, cycloalkenones, pyrimidines, reductones, and coumarins. Useful inorganic developing agents include compounds of a metal, having at least two distinct valence states, which are capable of reducing ionic silver to metallic silver. Such metals include iron, titanium, vanadium, and chromium and the metal compounds employed are typically complexes with organic compounds such as polycarboxylic acids or aminopolycarboxylic acids.

A particularly important class of black-and-white developing agents are the dihydroxybenzenes such as, for example, hydroquinone,
chlorohydroquinone,
bromohydroquinone,
isopropylhydroquinone,
toluhydroquinone,
methylhydroquinone,
2,3-dichlorohydroquinone,
2,5-dimethylhydroquinone,
2,3-dibromohydroquinone,
1,4-dihydroxy-2-acetophenone-2,5-dimethylhydroquinone,
2,5-diethylhydroquinone,
2,5-di-p-phenethylhydroquinone,
2,5-dibenzoylaminohydroquinone,
2,5-diacetaminohydroquinone, and the like.

A further particularly important class of black-and-white developing agents are the 3-pyrazolidones. Useful compounds of this class include those substituted in the 1-position by a monocyclic aryl group of the benzene series, including phenyl and substituted phenyl such as p-tolyl, p-chlorophenyl, etc. A typical compound of this type is 1-phenyl-3-pyrazolidone. In addition to this substitution in the 1-position, the pyrazolidone nucleus can be substituted in the 4-position, particularly by lower alkyl and substituted lower alkyl groups such as methyl and hydroxymethyl. Representative compounds of this class are:

1-phenyl-4-methyl-3-pyrazolidone,
1-phenyl-4-hydroxymethyl-3-pyrazolidone,
1-phenyl-4,4-dimethyl-3-pyrazolidone, and
1-phenyl-4,4-di(hydroxymethyl)-3-pyrazolidone.

Color developers typically contain primary aromatic amino color developing agents. These color developing agents are well known and widely used in a variety of color photographic processes. They include aminophenols and p-phenylenediamines.

Examples of aminophenol developing agents include o-aminophenol, p-aminophenol, 5-amino-2-hydroxytoluene, 2-amino-3-hydroxy-toluene, 2-hydroxy-3-amino-1,4-dimethylbenzene, and the like.

Particularly useful primary aromatic amino color developing agents are the p-phenylenediamines and especially the N-N-dialkyl-p-phenylenediamines in which the alkyl groups or the aromatic nucleus can be substituted or unsubstituted. Examples of useful p-phenylenediamine color developing agents include:

N-N-diethyl-p-phenylenediamine monohydrochloride,
4-N,N-diethyl-2-methylphenylenediaminemonohydrochloride,
4-(N-ethyl-N-2-methanesulfonylaminoethyl)-2-methyl-phenylenediamine sesquisulfate monohydrate,
4-(N-ethyl-N-2-hydroxyethyl)-2-methyl-phenylenediamine sulfate,
4-N,N-diethyl-2,2'-methanesulfonylaminoethylphenylene-diamine hydrochloride, and the like.

An especially preferred class of p-phenylenediamine developing agents are those containing at least one alkylsulfonamidoalkyl substituent attached to the aromatic nucleus or to an amino nitrogen. Other especially preferred classes of p-phenylenediamines are the 3-alkyl-N-alkyl-N-alkoxyalkyl-p-phenylenediamines and the 3-alkoxy-N-alkyl-N-alkoxyalkyl-p-phenylenediamines. These developing agents are described in U.S. Pat. Nos. 3,656,950 and 3,658,525 and can be represented by the formula:

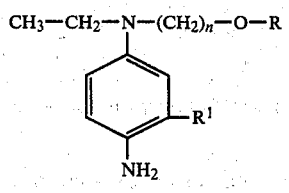

wherein n is an integer having a value of from 2 to 4, R is an alkyl group of from 1 to 4 carbon atoms, and $R^1$ is an alkyl group of from 1 to 4 carbon atoms or an alkoxy group of from 1 to 4 carbon atoms. Illustrative examples of these developing agents include the following compounds:

N-ethyl-N-methoxybutyl-3-methyl-p-phenylenediamine,
N-ethyl-N-ethoxyethyl-3-methyl-p-phenylenediamine,
N-ethyl-N-methoxyethyl-3-n-propyl-p-phenylenediamine,
N-ethyl-N-methoxyethyl-3-methoxy-p-phenylenediamine,
N-ethyl-N-butoxyethyl-3-methyl-p-phenylenediamine, and the like.

In addition to the primary aromatic amino color developing agent, color developer compositions typically contain a variety of other agents such as alkalies to control pH, bromides, iodides, benzyl alcohol, anti-oxidants, solubilizing agents, sequestering agents, brightening agents, and so forth.

The three essential components of the developing compositions of this invention, namely the developing agent, the indazole antifoggant and the lignosulfonate, can be used in any amount which is effective for the intended purpose. The developing agent will generally be used in amounts of from about 5 to about 50 grams per liter of working solution, and most usually in an amount in the range from about 25 to about 40 grams per liter. The indazole antifoggant will generally be used in amounts of from about 0.01 to about 2 grams per liter of working solution, and most usually in an amount in the range from about 0.1 to about 0.3 grams per liter. The lignosulfonate will generally be used in amounts of from about 0.001 to about 3 grams per liter of working solution, and most usually in an amount in the range from about 0.005 to about 0.1 grams per liter. Any of a wide variety of other optional ingredients can be present in the developing composition along with the three essential components.

Use of a lignosulfonate is especially advantageous in hardening developers used in the processing of X-ray films. Such developers typically contain a dihydroxybenzene developing agent, such as hydroquinone, a pyrazolidone developing agent, such as 1-phenyl-3-pyrazolidone, a dialdehyde, such as glutaraldehyde bis bisulfite, which functions as a hardening agent, and an indazole antifoggant, such as 5-nitroindazole. In this type of developer, it is commonly necessary to use the 5-nitroindazole antifoggant at a relatively high concentration and thus the precipitation problem is a severe one, and the lignosulfonate is of particularly great benefit in alleviating the problem.

In addition to glutaraldehyde, dialdehydes which are useful as hardening agents in the X-ray developers of this invention include alpha-methyl glutaraldehyde, beta-methyl glutaraldehyde, maleic dialdehyde, succinic dialdehyde, methoxy succinic dialdehyde, alpha-alpha-dimethyl glutaraldehyde, alpha-beta-dimethyl glutaraldehyde, methyl maleic dialdehyde, methyl succinic dialdehyde, alpha-methyl-beta-ethoxy glutaraldehyde, alpha-n-butoxy glutaraldehyde, beta-n-butyl glutaraldehyde, beta-isopropoxy succinic dialdehyde and butyl maleic dialdehyde. The dialdehyde hardening agents cann be used as such or in the form of bisulfite derivatives of alkali metal bisulfites, alkaline earth metal bisulfites, or nitrogen base bisulfites.

In the packaging of photographic developers, it is a common practice to separate the components into two or more parts, often in the form of liquid concentrates, which are subsequently combined and diluted with water to form a working developing solution. This is done in order to avoid the tendency for deleterious chemical interactions to take place between certain of the components. In the practice of the present invention, it is a matter of choice as to which of such parts is utilized as the part which contains the lignosulfonate. In other words, the lignosulfonate can be incorporated in any of the parts, as desired. Since pH is a major factor affecting the tendency of the indazole antifoggants to precipitate, there may be no precipitation problem in the liquid concentrate which contains the indazole. However, where such problem does exist, inclusion of the lignosulfonate in the concentrate that contains the indazole will be effective both to avoid precipitation in the concentrate, and to avoid precipitation in the working developing solution.

The black-and-white developing compositions described herein can be advantageously employed in the processing of graphic arts films or in the processing of X-ray films. Development of photographic elements in the color developer compositions described herein can be advantageously employed in the processing of photographic elements designed for reversal color processing or in the processing of negative color elements or color print materials. The stabilized developing compositions of the invention can be employed with photographic elements which are processed in color developers containing couplers or with photographic elements which contain the coupler in the silver halide emulsion layers or in layers contiguous thereto. The photosensitive layers present in the photographic elements processed according to the method of this invention can contain any of the conventional silver halides as the photosensitive material, for example, silver chloride, silver bromide, silver bromoiodide, silver chlorobromide, silver chloroiodide, silver chlorobromoiodide, and mixtures thereof. These layers can contain conventional addenda and can be coated on any of the photographic supports, such as, for example, cellulose nitrate film, cellulose acetate film, polyvinyl acetal film, polycarbonate film, polystyrene film, polyethylene terephthalate film, paper, polymer-coated paper, and the like.

Processes employing the developer compositions of this invention can vary widely in regard to such features as development time and development temperature. Thus, for example, the development time will typically be in the range from about 0.2 to about 20 minutes, and more usually in the range from about 0.5 to about 4 minutes, while the development temperature will typically be in the range from about 15° C. to about 55° C., and more usually in the range from about 25° C. to about 40° C.

The stabilized developing compositions of this invention are especially useful in the rapid processing of X-ray film, as described, for example, in Barnes et al, U.S. Pat. No. 3,545,971 issued Dec. 8, 1970.

The invention is further illustrated by the following examples of its practice.

EXAMPLE 1

A black-and-white photographic developing solution (referred to hereinafter as Solution A) suitable for use in the processing of X-ray film was prepared in accordance with the following formulation:

| Component | Amount (grams) |
|---|---|
| Potassium hydroxide | 29.14 |
| Glacial acetic acid | 10.96 |
| Potassium sulfite | 44.20 |
| Sodium bicarbonate | 7.50 |
| Boric Acid | 1.00 |
| Diethylene glycol | 28.96 |
| Ethylenediaminetetraacetic acid | 1.67 |
| Carbowax 350 | 0.25 |
| 5-Methylbenzotriazole | 0.06 |
| 5-Nitroindazole | 0.25 |
| Hydroquinone | 30.00 |
| 1-Phenyl-3-pyrazolidone | 1.50 |
| Glutaraldehyde | 4.93 |
| Sodium metabisulfite | 12.60 |
| Water to one liter | |

Developing solutions B and C were also prepared and were identical to Solution A except that a lignosulfonate (available commercially as Marasperse M-22 from American Can Company) was included in Solution B at a concentration of 0.25 grams per liter and in Solution C at a concentration of 2.5 grams per liter.

The three solutions were stored in covered glass containers at 5° C. for a period of four weeks. Formation of a fine crystalline precipitate, identified by analysis as 5-nitroindazole, occurred in Solution A, whereas both Solution B and Solution C exhibited no precipitate formation during the four-week period of storage.

EXAMPLE 2

Example 1 was repeated using the following lignosulfonates in place of the Marasperse M-22:

Orzan A at concentrations of 0.50 and 0.25 grams per liter.

Orzan S at concentrations of 0.50 and 0.25 grams per liter.

Lignosite 854 at concentrations of 0.50, 0.25, 0.20, 0.15, 0.10, 0.05 and 0.01 grams per liter.

Lignosite 458 at concentrations of 0.50, 0.25, 0.20, 0.15, 0.10, 0.05 and 0.01 grams per liter.

Reax 81A at concentrations of 0.50, 0.25, 0.20, and 0.15 grams per liter.

Lignosol NSX135 at concentrations of 0.25, 0.20, 0.15, 0.10, 0.05 and 0.01 grams per liter.

Lignosol SF at concentrations of 0.25, 0.20 and 0.15 grams per liter.

In every case, the lignosulfonate prevented the precipitation of the 5-nitroindazole during the four-week period of storage at 5° C.

As shown by the above examples, the lignosulfonates effectively suppress the precipitation of indazole antifoggants in photographic developers. It should be noted that neither the wood sugars, e.g., mannose, glucose, xylose and galactose, nor the hemlock tannin polymers are effective for this purpose. Sulfonated polystyrenes, styrene-maleic anhydride copolymers, and carboxymethyl cellulose have also been tested and found to be ineffective. Thus, the ability of the lignosulfonates to solve the difficult problem of precipitation of indazole antifoggants is quite unexpected.

The invention has been described in detail with particular reference to preferred embodiments thereof, but it will be understood that variations and modifications can be effected within the spirit and scope of the invention.

I claim:

1. A photographic developing composition comprising at least one developing agent, an indazole antifoggant, and a lignosulfonate in an amount sufficient to suppress precipitation of said indazole antifoggant.

2. A photographic developing composition comprising at least one developing agent, a nitroindazole antifoggant, and a lignosulfonate in an amount sufficient to suppress precipitation of said nitroindazole antifoggant.

3. A photographic developing composition comprising at least one developing agent, 5-nitroindazole in an amount sufficient to act as an antifoggant, and a lignosulfonate in an amount sufficient to suppress precipitation of said 5-nitroindazole.

4. A developing composition as claimed in claim 1 containing a dihydroxybenzene developing agent.

5. A developing composition as claimed in claim 1 containing a primary aromatic amino color developing agent.

6. A developing composition as claimed in claim 1 wherein said lignosulfonate is a sodium lignosulfonate.

7. A developing composition as claimed in claim 1 additionally containing a dialdehyde hardening agent.

8. A working strength photographic developing solution comprising an aqueous solution containing a developing agent in an amount of from about 5 to about 50 grams per liter of solution, an indazole antifoggant in an amount of from about 0.01 to about 2 grams per liter of solution, and a lignosulfonate in an amount of from about 0.001 to about 3 grams per liter of solution.

9. A developing solution as claimed in claim 8 wherein said developing agent is a mixture of hydroquinone and 1-phenyl-3-pyrazolidone and said indazole antifoggant is 5-nitroindazole.

10. A photographic developing composition comprising hydroquinone, 1-phenyl-3-pyrazolidone, 5-methylbenzotriazole, 5-nitroindazole, glutaraldehyde and sodium lignosulfonate.

11. A process of developing a photographic element which comprises contacting said element with a developing solution containing at least one developing agent, an indazole antifoggant, and a lignosulfonate in an amount sufficient to suppress precipitation of said indazole antifoggant.

12. A process as claimed in claim 11 wherein said photographic element is an X-ray film, said developing agent comprises hydroquinone and 1-phenyl-3-pyrazolidone, and said indazole antifoggant is 5-nitroindazole.

13. A method of suppressing the precipitation of an indazole antifoggant in a photographic developing composition which comprises incorporating in said composition an effective amount of a lignosulfonate.

14. A method as claimed in claim 13 wherein said indazole antifoggant is 5-nitroindazole.

15. A method as claimed in claim 13 wherein said developing composition is an X-ray developer containing a dihydroxybenzene developing agent, a pyrazolidone developing agent, and a nitroindazole.

16. A method as claimed in claim 13 wherein said developing composition is an X-ray developer containing hydroquinone, 1-phenyl-3-pyrazolidone and 5-nitroindazole.

* * * * *